US008508326B2

(12) United States Patent
Kang et al.

(10) Patent No.: US 8,508,326 B2
(45) Date of Patent: Aug. 13, 2013

(54) SURGE PROTECTION DEVICE USING METAL OXIDE VARISTORS (MOVS) AS THE ACTIVE ENERGY CONTROL MULTIPLE GAP DISCHARGING CHAIN

(75) Inventors: Guo Yao Kang, ShenZen (CN); Hui Ping Guo, ShenZen (CN); Bing Yu Shi, ShenZen (CN); Wen Hu Shi, ShenZen (CN); Rong Huang, ShenZen (CN); Ya Ping Guo, ShenZen (CN)

(73) Assignee: Shenzhen Dowin Lighting Technologies Co., Ltd., Shekou, Shenzhen (CN)

( * ) Notice: Subject to any disclaimer, the term of this patent is extended or adjusted under 35 U.S.C. 154(b) by 15 days.

(21) Appl. No.: 13/379,780

(22) PCT Filed: Nov. 8, 2011

(86) PCT No.: PCT/US2011/059764

§ 371 (c)(1),
(2), (4) Date: Dec. 21, 2011

(87) PCT Pub. No.: WO2012/064729

PCT Pub. Date: May 18, 2012

(65) Prior Publication Data

US 2012/0112872 A1 May 10, 2012

Related U.S. Application Data

(60) Provisional application No. 61/411,041, filed on Nov. 8, 2010.

(51) Int. Cl.
*H01C 7/10* (2006.01)

(52) U.S. Cl.
USPC ..... 338/21; 338/13

(58) Field of Classification Search
USPC ..... 338/21
See application file for complete search history.

(56) References Cited

U.S. PATENT DOCUMENTS

| | | | | |
|---|---|---|---|---|
| 4,276,578 | A | 6/1981 | Levinson et al. | |
| 5,392,188 | A * | 2/1995 | Epstein | 361/118 |
| 6,396,678 | B1 | 5/2002 | Meppelink et al. | |
| 6,437,664 | B1 | 8/2002 | Meppelink et al. | |
| 6,501,634 | B1 * | 12/2002 | Hubbell | 361/124 |
| 6,930,871 | B2 * | 8/2005 | Macanda | 361/117 |
| 2010/0127625 | A1 | 5/2010 | Minarczyk et al. | |

FOREIGN PATENT DOCUMENTS

| | | |
|---|---|---|
| CN | 1377108 | 10/2002 |
| CN | 101090197 | 12/2007 |
| GB | 2376139 | 5/2005 |
| KR | 20080084147 | 9/2008 |
| KR | 20100073222 | 7/2010 |
| WO | 99/67863 | 12/1999 |

* cited by examiner

*Primary Examiner* — Kyung Lee
(74) *Attorney, Agent, or Firm* — Snell & Wilmer, LLP

(57) ABSTRACT

The present invention may provide a surge protection device, which may include a reference node, first, second, and third nodes, a first arcing section (GAP) coupled between the first and second nodes, and configured to receive a surge voltage from the first node, a first metal oxide varistor (MOV) coupled between the second and reference nodes, and configured to reduce the surge voltage to a first sub-surge voltage at the second node, a second arcing section (GAP) coupled between the second and third nodes, and configured to receive the first sub-surge voltage from the second node, and a second metal oxide varistor (MOV) coupled between the third and reference nodes, and configured to reduce the first sub-surge voltage to a second sub-surge voltage at the third node.

17 Claims, 4 Drawing Sheets

SURGE PROTECTION DEVICE USING METAL OXIDE VARISTORS (MOVS) AS THE ACTIVE ENERGY CONTROL MULTIPLE GAP DISCHARGING CHAIN

CROSS REFERENCE TO RELATED APPLICATIONS

This application claims the benefit and priority of U.S. Provisional Patent Application No. 61/411,041, filed on Nov. 8, 2010, entitled "Surge Protection Device Using Metal Oxide Varistors as Auxiliary Discharge Devices," the entire contents of which is incorporated herein by reference.

BACKGROUND

1. Field of the Invention

The present invention relates to surge protection devices applied to or used in a power supply system, and specifically for spark gap surge protection devices. The surge protection devices are mainly applied in Class I and Class II surge protection of power supply systems such as power distributors, cell sites, and power transfer stations. The surge protection devices provide for the protection of surge currents and voltages traveling to electronic equipment and systems. The surge currents and voltages are caused by lightning, transient over-voltages and operation over-voltages, which can all cause the breakdown of electronic equipment and systems.

2. Description of Related Art

Several different types of surge protection devices have been used to protect electronic components from sudden surge currents or voltages caused by lightning or other sources.

A first type of surge protection device is a metal oxide varistor surge protection device (MOV SPD). The MOV SPD has been widely applied to or used in a variety of fields to protect against surge currents and voltages. When the MOV SPD is stricken by high surge energy, it is easily broken down by thermal runaway or an electronic current impulse strike. The withstanding capability of Class I current impulse SPDs under IEC 61643-1 (2005) (Low-voltage surge protective devices—Surge protective devices connected to low-voltage power distribution systems—Requirements and tests) is no more than 20 kA (10/350 us). To maintain good application results, the MOV SPD includes a coated or sealed MOV with a suitable power lead.

A second type of surge protection device is a spark gap surge protection device with an auxiliary discharging trigger (SG SPD). The SG SPD has been widely applied to or used in a variety of fields to protect against surge currents and voltages. For example, when the SG SPD is applied to a power supply system, the main concern is the problem of the follow current. That is, when the SG SPD is turned on by the surge current and over-voltage, the surge current is discharging to the ground through the SG SPD; however, the SG SPD does not address how to quench the arc or how to turn off the follow current in a safe way—this problem is addressed or solved by the present invention.

For a single SG SPD, when there is a discharging current in the gap, a transient high temperature arc is produced or exists in the gap and makes one of the insulating materials, named Gas-Evolving Insulating Materials, release a special gas. This special gas pressure increases rapidly to generate a sudden gas flow in the gap. This gas flow creates a gas flow arc voltage between the electrodes of the SG. When the gas flow arc voltage value is greater than a voltage value of the power supply, the arc is quenched. This describes how the single SG works as the SPD.

There are two different kinds of SG SPDs. The first one has a higher arc trigger voltage with a higher residential voltage of more than 3,000V and a lower protection level. The first one cannot protect the system and equipment against the surge well. The second one has a transient high temperature arc and a high pressure gas flow. The second one includes the Gas-Evolving Insulating Material and strength of mechanics cavity with a complicated manufacturing process.

A third type of surge protection device is a surge protection device having multiple serial gaps with capacitors as the divide voltage discharging chain. As there are multiple gaps in serial, the whole arc voltage is the single gap arc added as the serial chain so the whole arc voltage is higher than the single spark gap arc's voltage. When the whole arc voltage is higher than the source power voltage (peak value), the arc is quenched in time. Currently, two kinds of multiple spark gap SPDs exist in the China market. The first one is a high efficiency overlap graphite gap SPD (China Patent No. CN 101090197A). The second one is a lightning discharging spark gap SPD (China Patent No. CN 1377108A). These two kinds of SPDs have at least two significant drawbacks. The first drawback is that the discharge voltage is not stable and the residential voltage is higher than 2,500V (if it is tested by IEC 61643-1 (2005) 1.2/50 us@ 6 kV). The second drawback is that it is difficult to control the discharging energy, when it is tested by class I current wave 10/350 us strike, and the capacitor is easy to breakdown and in the worse case it is easy to explode.

Thus, there is a need to provide a surge protection device with improved qualities and functionalities.

SUMMARY

The present invention provides a surge protection device (SPD) using metal oxide varistors (MOVs) as the active energy control multiple gap dischaging chain. There are several technologies to be resolved, but there are at least two key technologies present. The first is a lower residential voltage. With this invention, the residential voltage of the SPD can be at a level lower than 2,000V, and with a fine tune and design, the residential voltage can be at a level lower than 1,500V. This allows for a better way to protect the system and equipment from the surge current and voltage damage. The second is an active discharging energy control. The energy through the MOV is actively controlled by adjustment of both the gap distance and the MOV discharging current. Under the condition of the discharging current being lower than the maximum discharging current (Imax) of the SPD, it is to control the energy through the MOV to be lower than the maximum withstanding energy before the gap is turned on, to realize the discharging energy active control with the trigger MOV working safely. So it is realized both for the gaps to pass through higher surge currents and the auxiliary trigger MOV to work safely.

In one embodiment, the present invention may provide a surge protection device, which may include a reference node, first, second, and third nodes, a first arcing section (GAP) coupled between the first and second nodes, and configured to receive a surge voltage from the first node, a first metal oxide varistor (MOV) coupled between the second and reference nodes, and configured to reduce the surge voltage to a first sub-surge voltage at the second node, a second arcing section (GAP) coupled between the second and third nodes, and configured to receive the first sub-surge voltage from the second node, and a second metal oxide varistor (MOV) coupled between the third and reference nodes, and configured to reduce the first sub-surge voltage to a second sub-surge voltage at the third node.

BRIEF DESCRIPTION OF THE DRAWINGS

Other systems, methods, features and advantages of the present invention will be or will become apparent to one with skill in the art upon examination of the following figures and detailed description. It is intended that all such additional systems, methods, features and advantages be included within this description, be within the scope of the present invention, and be protected by the accompanying claims. Component parts shown in the drawings are not necessarily to scale, and may be exaggerated to better illustrate the important features of the present invention. In the drawings, like reference numerals designate like parts throughout the different views, wherein:

DETAILED DESCRIPTION

Apparatus, systems and methods that implement the embodiment of the various features of the present invention will now be described with reference to the drawings. The drawings and the associated descriptions are provided to illustrate some embodiments of the present invention and not to limit the scope of the present invention. Throughout the drawings, reference numbers are re-used to indicate correspondence between reference elements. In addition, the first digit of each reference number indicates the figure in which the element first appears.

The surge protection devices (SPDs) described herein use metal oxide varistors (MOVs) as the active energy control multiple gap dischaging chain. The SPD is mainly applied in an AC power supply system, such as between the line of L-N and N-PE. Normally, the SPD is comprised of (n+1) pieces of higher temperature withstanding conductors as the gap (or to create the gap) and (n) pieces of insulating frames or slides or sheets to fill in the gap, and (n−1) MOVs to form the discharging trigger chain, with other parts to integrate the complete SPD, such as a connector, plastic enclosure, fuse (optional), indicator (optional) and terminal and so on. Below is an explanation of the working principles and concepts for the circuits and structure.

Figure 1:
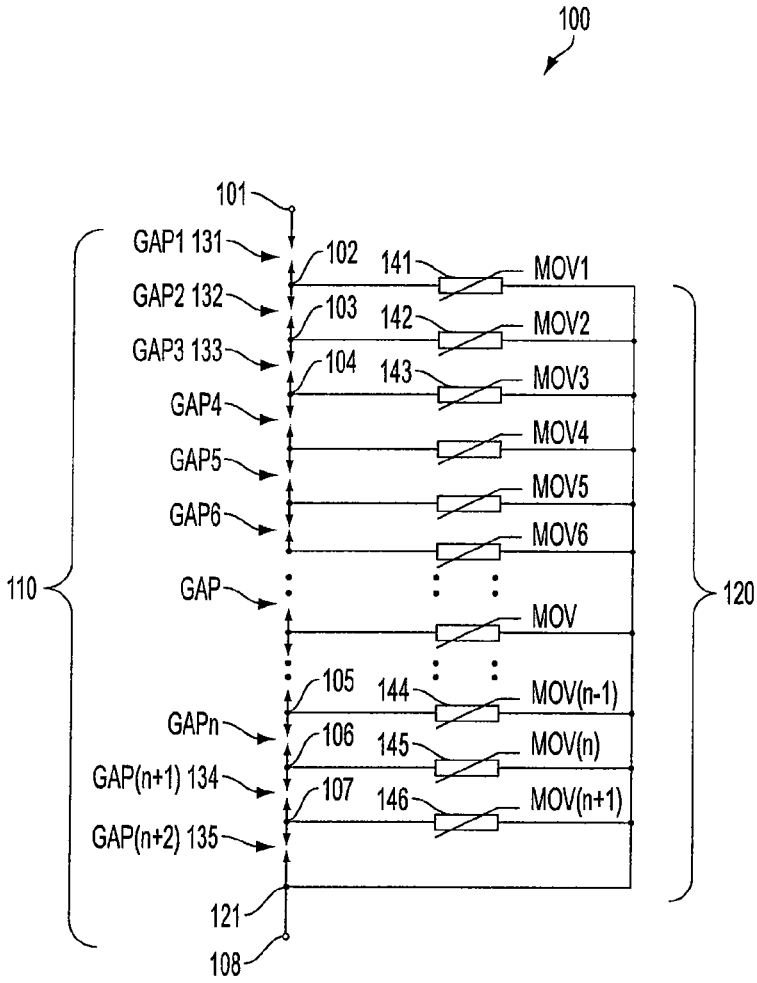
FIG. 1 shows a schematic view of a general surge protection device using MOVs as the active energy control multiple gap discharging chain according to an embodiment of the present invention.

In FIG. 1, a schematic view of a surge protection device 100 is shown according to an embodiment of the present invention. The surge protection device 100 uses two or more metal oxide varistors (MOVs) as the active energy control multiple gap discharging chain. Generally, the surge protection device 100 may have two or more arcing sections (e.g., GAPs) which may be coupled to one another in series and two or more auxiliary discharge devices (e.g., MOVs) which may be coupled to one another in parallel. The arcing sections may be used to form a discharge path for discharging a surge voltage, while the multiple auxiliary discharge devices may be used for reducing the frequency and/or magnitude of the surge voltage while it is being discharged via the arcing sections. As discussed herein, an auxiliary discharge device may be any device that is capable of dampening and/or dissipating the energy created by the surge voltage. For example, each auxiliary discharge device may be a capacitor, a resistor, an inductor, an MOV or combinations thereof. In one embodiment, the surge protection device 100 includes only MOVs for the auxiliary discharge devices and does not include any capacitors, resistors and inductors.

According to an embodiment of the present invention, the auxiliary discharge devices may be formed solely by one or more metal oxide varistors (a.k.a. variable resistors), which may each have a non-linear voltage-current characteristic. As shown in FIG. 1, the surge protection device 100 may have a discharge path 110 including one or more arcing sections (GAP), and a dampening network 120 including one or more metal oxide varistors (MOVs).

More specifically, the discharge path 110 may include a first arcing section (GAP 1) 131 which may be coupled between a first node 101 (or an input node 101) and a second node 102, a second arcing section (GAP2) 132 which may be coupled between the second node 102 and a third node 103, and a third arcing section (GAP3) 133 which may be coupled between the third node 103 and a fourth node 104. The discharge path 110 may include as many arcing sections as is desirable. For instance, assuming n to be an arbitrary number, the discharge path 110 may include an (n+1)th arcing section ($GAP_{n+1}$) 134 which may be coupled between an (n+1)th node 106 and an (n+2)th node 107.

The dampening network 120 may include a first metal oxide varistor (MOV1) 141 which may be coupled between the second node 102 and a reference node 121, a second metal oxide varistor (MOV2) 142 which may be coupled between the third node 103 and the reference node 121, a third metal oxide varistor (MOV3) 143 which may be coupled between the fourth node 104 and the reference node 121, and up to an (n+1)th metal oxide varistor ($MOV_{n+1}$) 146 which may be coupled between the (n+2)th node 107 and the reference node 121.

In one embodiment, the GAP1 131 may receive a surge voltage from the first node 101, and it may discharge the surge voltage across the first arcing section 131 and to the second node 102. The MOV1 141 may reduce the energy of the received surge voltage by a predefined magnitude, such that the third node 103 may receive a first sub-surge voltage, which may be less than the surge voltage. Similarly, the MOV2 142 may reduce the energy of the received sub-surge voltage by another predefined magnitude, such that the fourth node 104 may receive a second sub-surge voltage, which may be less than the first sub-surge voltage. The effect of this energy reduction process may be repeated, cascaded and amplified by the multiple MOVs residing in the dampening network 120. Accordingly, the (n+2)th node 107, which may also be the reference node 121 and/or an output node 108, may receive a well dampened voltage when compared to the first node 101.

Because of the V-I characteristics of the MOVs, the dampening network 120 may be able to suppress the surge voltage in a steady, efficient and effective manner. Compared to DC capacitor based auxiliary discharge devices, MOVs provide significant improvements in terms of oscillation reduction and peak current surge control. Advantageously, the surge protection device 100 may produce residual voltage with little fluctuation and a smooth transient profile.

In sum, it is a chain discharge process, when the over-voltage between the first node 101 and the reference node 121 or the output node 108 reaches the break-over voltage of the GAP1 131, the GAP1 131 is triggered on through the loop of the MOV1 141 and the reference node 121, and accordingly current passes through such loop to form the residual voltage of the MOV1 141. If the residual voltage reaches the break-over voltage of the GAP2 132, the GAP2 132 is triggered on through the loop of the MOV2 142 and the reference node 121, such discharge process continue until the residual voltage of the (n+1)th MOV causes the GAP(n+2) 135 to work, for the whole discharge process. The voltage protection level for such products can be limited below the residual voltage of the MOV1 141 and the arc voltage of the GAP1 131. Moreover, accumulation of the arc voltage between the first node 101 and the (n+2)th node 107 can assist the product to solve follow current interrupting problems. The quantity of the MOV and the spark gaps is dependent on what power voltage is needed. In one embodiment, the total number of GAPS is 1 more than the total number of MOVs.

The surge protection device 100 uses MOVs as the active energy control multiple gap discharging chain. The surge protection device 100 includes n gaps in series and (n−1) MOVs which are connected to (n−1) GAPs one by one in shunt to one end together as the chain. The power end of the surge protection device 100, the electronic end 101 of the 1st GAP among the n GAPS chain, is connected with the main power line, and another end of the 1st GAP (node 102) is then connected with one end of the 1st MOV 141 among the (n−1) MOV chains. Another power end of the surge protection device 100, one electronic end (node (n+1)) of the nth GAP is then connected with another power line loop, together with the (n−1) MOV shunt points. One end of the (n−1) MOV is connected to one end of the (n−1) GAPS in order, and the other end of the (n−1) MOV is connected to one end of the nth GAP in shunt joints, the same point as another power end of the surge protection device 100, connected to the power line as the joints. For the surge protection device 100 demonstrated in FIG. 1, it is shown as (n+2) GAPS and (n+1) MOVs for illustrative purposes.

Each discharging individual gap is made up of high temperature withstanding conductors and an insulation dielectric where the distance or width of each gap is about 0.15 millimeters (mm) to about 1 mm. In one embodiment, the distance between each gap (e.g., from a first gap to a second gap) is about 0.15 mm to about 1 mm. The turn-on voltage of each MOV is from about 300V to about 1,500V. In one embodiment, the turn-on voltage for all the MOVs is the same or substantially the same. In another embodiment, the turn-on voltage for each MOV is different. In one embodiment, the base number n is more than the natural number 3. The connection types include metal conductors for the power connection and also include over-current fuses and over-temperature fuses. The high temperature conductors may be made of one or more conductive materials such as graphite, brass, copper and bronze and their alloy metal conductive materials and so on.

Figure 2:
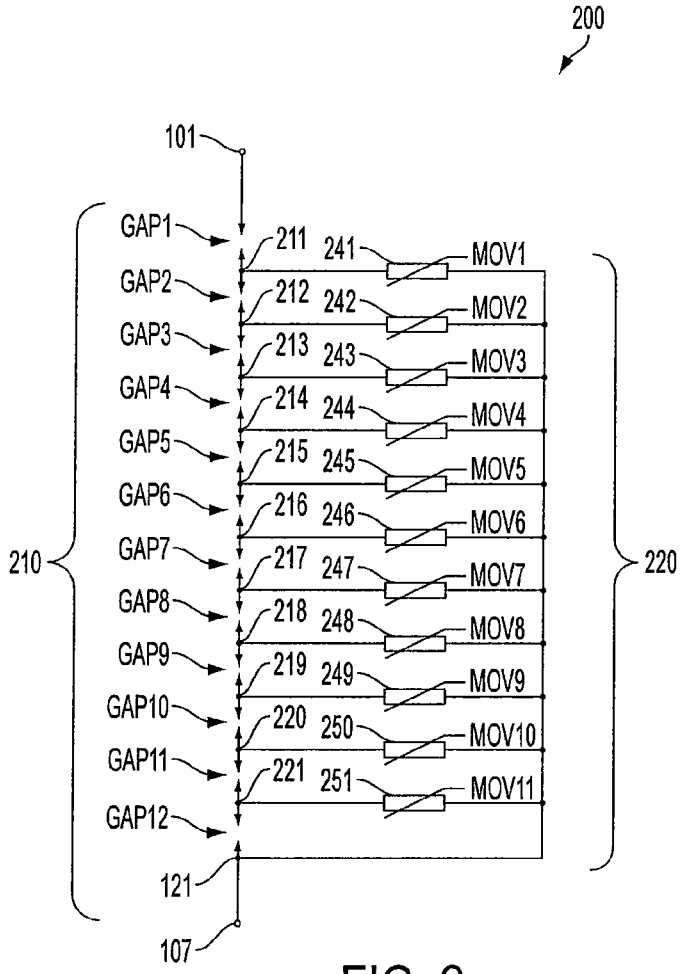
FIG. 2 shows a schematic view of an exemplary implementation of the surge protection device of FIG. 1 having 12 GAPs and using 11 MOVs as the active energy control multiple gap discharging chain according to an embodiment of the present invention.

FIG. 2 shows a schematic view of an exemplary implementation of the surge protection device 100 of FIG. 1 having 12 GAPs and using 11 MOVs as the active energy control multiple gap discharging chain. As shown in FIG. 2, the surge protection device 200 may have a discharge path 210 including 12 arcing sections (GAPs), and a dampening network 220 including 11 MOVs. FIG. 2 is an example embodiment and any number of arcing sections (GAPs) and MOVs may be used.

Figure 3:
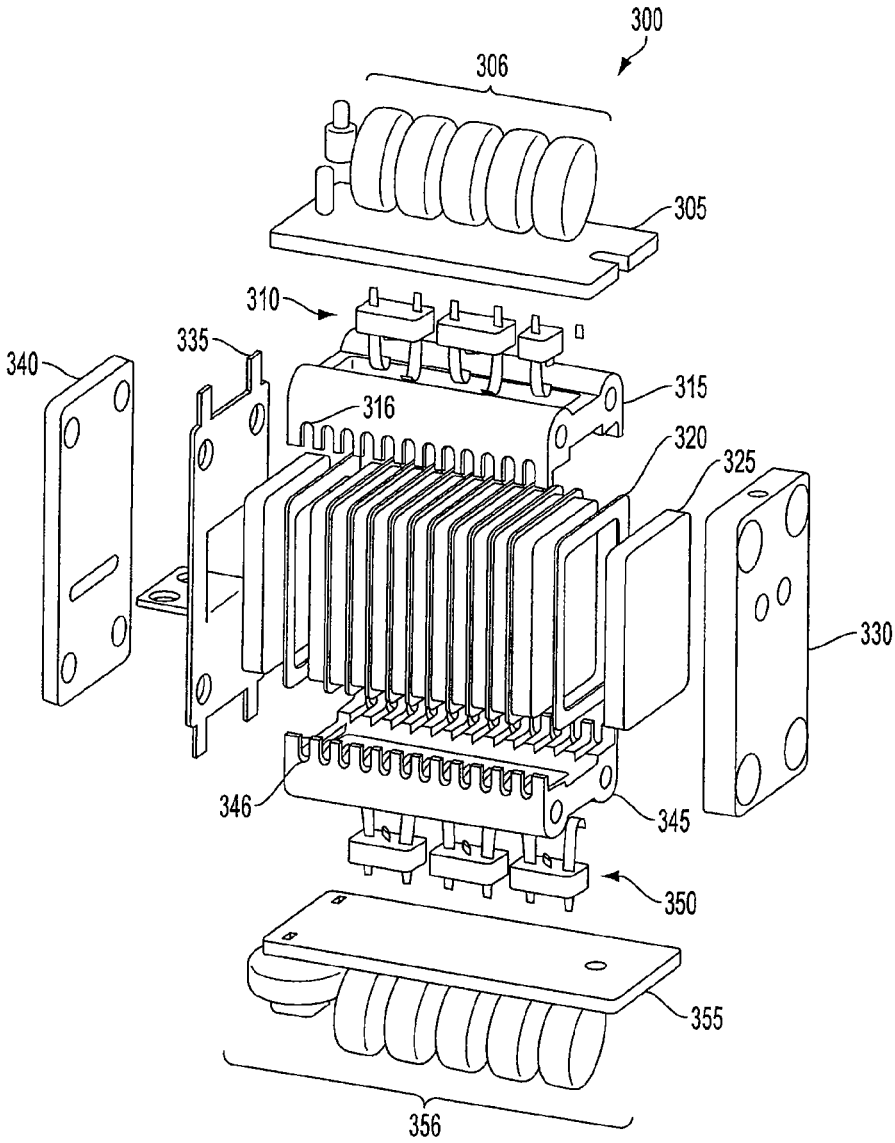
FIG. 3 shows a disassembled physical structure of a surge protection device that is one way to implement the schematic circuit shown in FIG. 2.

FIG. 3 shows a disassembled physical structure of a surge protection device 300 that is one exemplary implementation of the schematic circuit shown in FIG. 2. The surge protection device 300 may include an upper printed circuit board (PCB) unit 305, a first plurality of MOVs 306 mounted to the upper PCB unit 305, an upper flexible pole unit 310, an upper plastic bracket 315, a plurality of insulating frames, sheets or plates 320 (e.g., PTFE slices or insulators), a plurality of high temperature withstanding conductors 325 (e.g., graphite slices or conductors), a right electrode plate 330, a left electrode plate 335, a metal bracket 340, a lower plastic bracket 345, a lower flexible pole unit 350, a lower PCB unit 355, and a second plurality of MOVs 356 mounted to the lower PCB unit 355. The plurality of insulating frames 320 are positioned substantially parallel to one another and alternate with the plurality of high temperature withstanding conductors 325, which are also positioned substantially parallel to one another. The upper plastic bracket 315 and the lower plastic bracket 345 each have 12 channels, grooves or notches 316 and 346 that extend or pass from a front side to a rear side and that fit or receive the plurality of insulating frames 320 and/or the plurality of high temperature withstanding conductors 325. In one embodiment, the grooves or notches 316 and 346 hold the plurality of insulating frames 320 and/or the plurality of high temperature withstanding conductors 325 in place so they are all substantially parallel to one another. The first and second plurality of MOVs 306 and 356 are coupled to the plurality of high temperature withstanding conductors 325 via the upper and lower flexible pole units 310 and 350, respectively.

Figure 4:
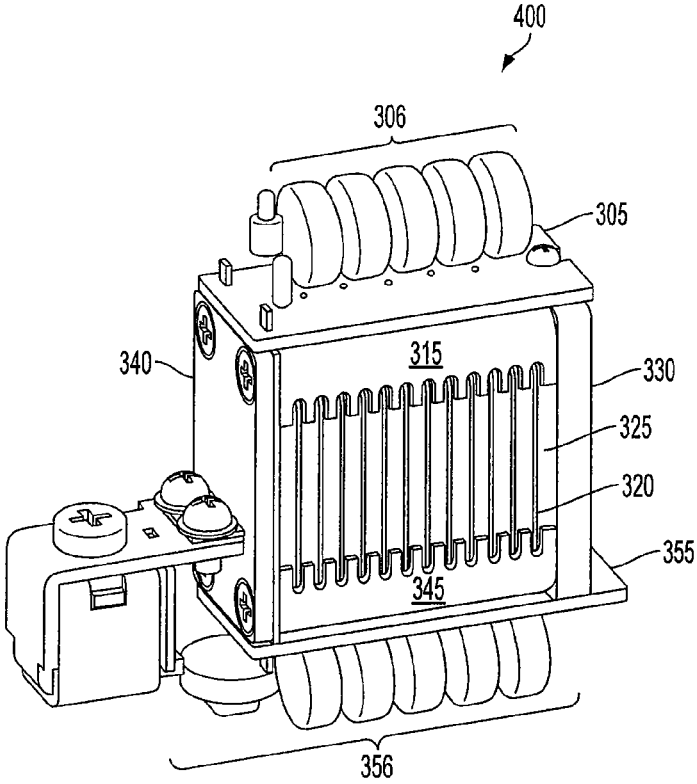
FIG. 4 shows an assembled physical structure of the surge protection device shown in FIG. 3.

FIG. 4 shows an assembled physical structure 400 of the surge protection device 300 that is one exemplary implementation of the schematic circuit shown in FIG. 2.

Exemplary embodiments of the invention have been disclosed in an illustrative style. Accordingly, the terminology employed throughout should be read in a non-limiting manner. Although minor modifications to the teachings herein will occur to those well versed in the art, it shall be understood that what is intended to be circumscribed within the scope of the patent warranted hereon are all such embodiments that reasonably fall within the scope of the advancement to the art hereby contributed, and that that scope shall not be restricted, except in light of the appended claims and their equivalents.

What is claimed is:

1. A surge protection device, comprising:

a reference node;

first, second, and third nodes;

a first arcing section coupled between the first node and the second node, and configured to receive a surge voltage from the first node;

a first metal oxide varistor coupled between the second node and the reference node, and configured to reduce the surge voltage to a first sub-surge voltage at the second node;

a second arcing section coupled between the second node and the third node, and configured to receive the first sub-surge voltage from the second node; and a second metal oxide varistor coupled between the third node and the reference node, and configured to reduce the first sub-surge voltage to a second sub-surge voltage at the third node.

2. The surge protection device of claim 1 wherein the first arcing section has a gap of between about 0.15 millimeters (mm) to about 1 mm.

3. The surge protection device of claim 2 wherein the second arcing section has a gap of between about 0.15 mm to about 1 mm.

4. The surge protection device of claim 1 wherein the first metal oxide varistor has a turn-on voltage of between about 300V to about 1,500V.

5. The surge protection device of claim 4 wherein the second metal oxide varistor has a turn-on voltage of between about 300V to about 1,500V.

6. The surge protection device of claim 1 wherein the first arcing section and the second arcing section are arranged in a series circuit configuration.

7. The surge protection device of claim 1 wherein the first metal oxide varistor and the second metal oxide varistor are arranged in a parallel circuit configuration.

8. The surge protection device of claim 1 wherein the first metal oxide varistor has a non-linear voltage-current characteristic.

9. The surge protection device of claim 1 wherein the second metal oxide varistor has a non-linear voltage-current characteristic.

10. The surge protection device of claim 1 wherein the first and second arcing sections form a discharge path for discharging the surge voltage and the first and second metal oxide varistors are used to reduce the frequency or magnitude of the surge voltage while the surge voltage is being discharged via the first and second arcing sections.

11. A surge protection device that reduces oscillation and allows for better peak current surge control, the surge protection device comprising:

an output node;

first, second, and third nodes;

a first arcing section coupled between the first node and the second node, and configured to receive a surge voltage from the first node;

a first metal oxide varistor coupled between the second node and the output node, and configured to reduce the surge voltage to a first sub-surge voltage at the second node;

a second arcing section coupled between the second node and the third node, and configured to receive the first sub-surge voltage from the second node; and a second metal oxide varistor coupled between the third node and the output node, and configured to reduce the first sub-surge voltage to a second sub-surge voltage at the third node, wherein the first and second arcing sections form a discharge path for discharging the surge voltage and the first and second metal oxide varistors are used to reduce the frequency or magnitude of the surge voltage while the surge voltage is being discharged via the first and second arcing sections.

12. The surge protection device of claim 11 wherein the first arcing section has a gap of between about 0.15 millimeters (mm) to about 1 mm.

13. The surge protection device of claim 12 wherein the second arcing section has a gap of between about 0.15 mm to about 1 mm.

14. The surge protection device of claim 11 wherein the first metal oxide varistor has a turn-on voltage of between about 300V to about 1,500V.

15. The surge protection device of claim 14 wherein the second metal oxide varistor has a turn-on voltage of between about 300V to about 1,500V.

16. The surge protection device of claim 11 wherein the first arcing section and the second arcing section are arranged in a series circuit configuration.

17. The surge protection device of claim 11 wherein the first metal oxide varistor and the second metal oxide varistor are arranged in a parallel circuit configuration.

* * * * *